US006684764B2

(12) United States Patent
Sebright et al.

(10) Patent No.: US 6,684,764 B2
(45) Date of Patent: Feb. 3, 2004

(54) APPARATUS FOR EXTRACTING LIQUID FROM A COMPOSITE MASS

(75) Inventors: Brent H. Sebright, Hopkins, MI (US); Stuart L. Sebright, Allegan, MI (US)

(73) Assignee: Sebright Products, Inc., Hopkins, MI (US)

( * ) Notice: Subject to any disclaimer, the term of this patent is extended or adjusted under 35 U.S.C. 154(b) by 0 days.

(21) Appl. No.: 09/681,369

(22) Filed: Mar. 26, 2001

(65) Prior Publication Data

US 2002/0134254 A1 Sep. 26, 2002

(51) Int. Cl.[7] ..... B30B 9/06
(52) U.S. Cl. ..... 100/127; 100/116
(58) Field of Search ..... 100/45, 116, 112, 100/127, 192, 110, 37, 179, 295, 125, 126, 129

(56) References Cited

U.S. PATENT DOCUMENTS 3,550,775 A * 12/1970 Cooley ..... 100/112
4,646,633 A * 3/1987 Falguieres ..... 100/116
4,665,817 A * 5/1987 Simpson ..... 100/116
4,691,628 A * 9/1987 Simpson ..... 100/116
5,012,731 A * 5/1991 Maisonneuve ..... 100/110
5,215,007 A 6/1993 Sebright et al. ..... 100/45
5,887,516 A * 3/1999 Sebright et al. ..... 100/116

* cited by examiner

*Primary Examiner*—Allen Ostrager
*Assistant Examiner*—Jimmy T. Nguyen
(74) *Attorney, Agent, or Firm*—McGarry Bair PC

(57) ABSTRACT

An apparatus for removing liquid from a composite mixture of liquid and solids comprises a hopper mounted atop a compactor ram assembly. A snout section and an extruder section are mounted axial to the compactor ram assembly. A hydraulically-operated ram compresses wet material into the snout and extruder sections. Under pressure from the ram, liquid in the waste material escapes from drainage holes in the snout section top, bottom, and sides, and the extruder section top, bottom, and sides. A platen, pivotally mounted to the extruder top plate near the exit of the device and biased with a constant pressure, controls the back pressure in the extruder and snout sections. The apparatus has an extruder section and snout section of the same constant cross section and coaxial with each other. In a second embodiment of the apparatus, certain of the walls may diverge to further facilitate access to the first platen through the exit opening.

5 Claims, 4 Drawing Sheets

APPARATUS FOR EXTRACTING LIQUID FROM A COMPOSITE MASS

BACKGROUND OF INVENTION

1. Field of the Invention

This invention relates to compression-operated liquid extraction devices. It is specifically directed to an improved design of the extruder section.

2. Description of Related Art

Batch process, compression-driven liquid extraction devices for dewatering waste material have been well known for many years. The material to be dewatered is a composite mass of liquid and solids which the device compresses to remove much of the liquid, leaving a drier product more suitable for land fill. The liquid in the material to be dewatered is typically not just water but also may include oils, greases, solvents and other liquids. Typical liquid and solid mixtures that require dewatering include paper pulp, garbage, animal hair and follicle solvent from leather manufacture, animal by-products, dairy products, and other wet waste products. The input composite material is typically 5%–15% solids.

U.S. Pat. No. 5,215,007 to Sebright, et al. entitled Apparatus for Extracting Liquid from a Composite Mass and which is incorporated herein by reference, discloses a liquid extraction device that utilizes an extruder section with a bottom wall that is inclined upwardly at an angle from a defined axis and side walls that converge toward the discharge end. The inclined bottom wall enables gravity to assist the end platen in maintaining sufficient compression of the dewatered solids at the discharge end. The output dewatered material from this device can typically be 54% or higher solids, greatly exceeding the dewatering capacity of previous known devices. However, it has been found that an inclined bottom wall and converging side walls inhibit expeditious repair of the main ram. Moreover, any convergence in the extruder sometimes increases friction between the dewatered solids and the extruder walls to an unacceptable degree.

SUMMARY OF INVENTION

The foregoing problems are solved by the present invention of an apparatus for extracting liquid from a composite mass of liquids and solids. The appartus comprises a housing having a cavity for receiving a composite mass of solids and liquid. The cavity has a longitudinal axis extending through and open end of the housing.

A powered first platen is mounted in the apparatus relative to the housing for movement from a retracted position away from the open end, along the longitudinal axis through the cavity to an extended position near the open end.

An extruder section is connected to the housing at the open end and has opposed top and bottom walls and opposed side walls. The top, bottom, and side walls define a channel centered on the longitudinal axis, and the extruder extends to an exit opening. Each of the walls has a matrix of apertures therethrough. None of the top, bottom, and side walls converge toward the longitudinal axis in the direction from the open end toward the exit opening, but at least one of them diverges away from longitudinal axis. Any or all of the walls can diverge form the longitudinal axis.

A second platen is mounted to one of the extruder walls near the exit opening for pivotable movement to restrict the cross-sectional area of the channel. Preferably, the second platen is biased toward a position restricting the cross-sectional area of the channel.

BRIEF DESCRIPTION OF DRAWINGS

The invention will now be described with reference to the following drawings wherein.

DETAILED DESCRIPTION

Figure 1:
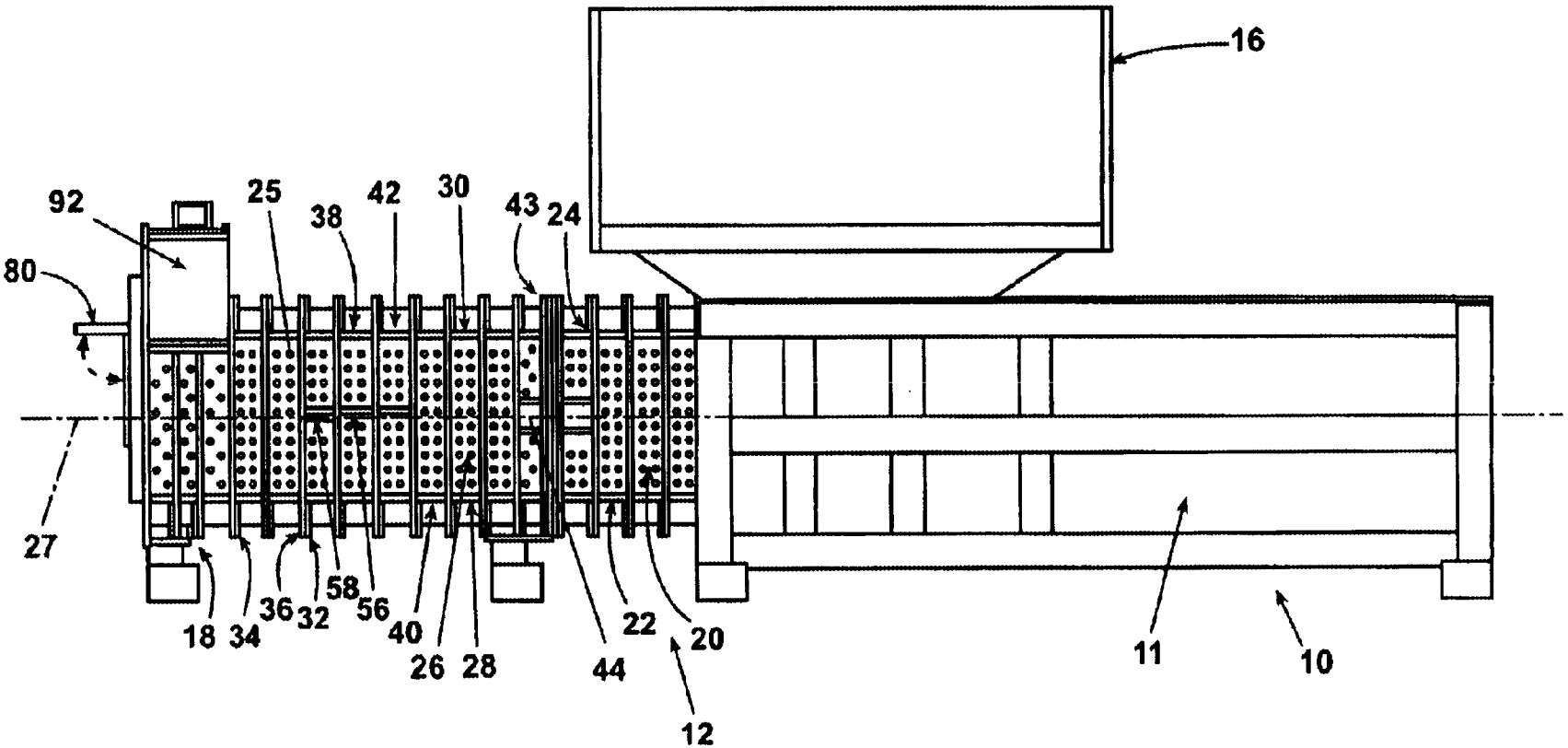
FIG. 1 is a left side elevation of an embodiment of a dewatering device according to the invention.
Figure 2:
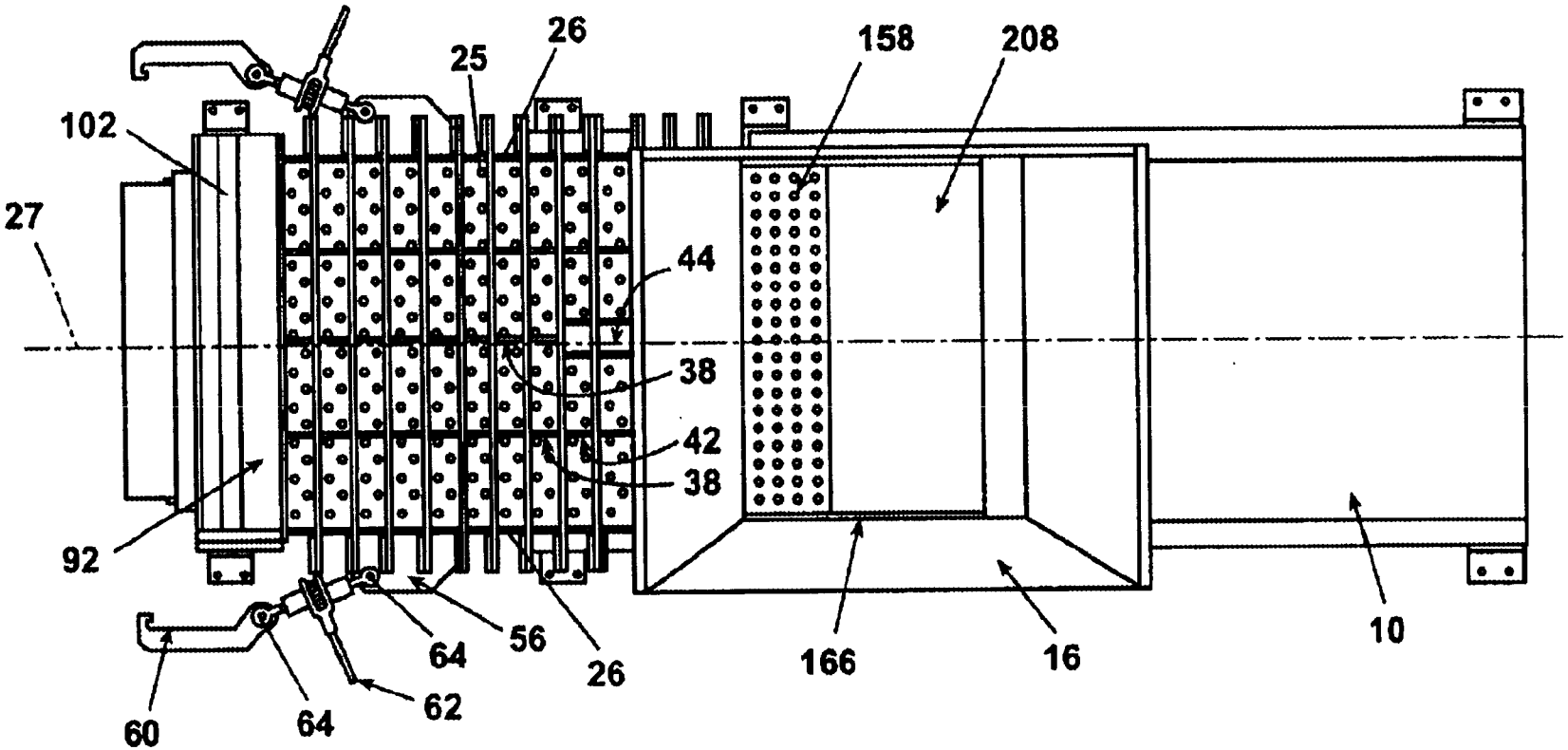
FIG. 2 is a plan view of the dewatering device of FIG. 1.
Figure 3:
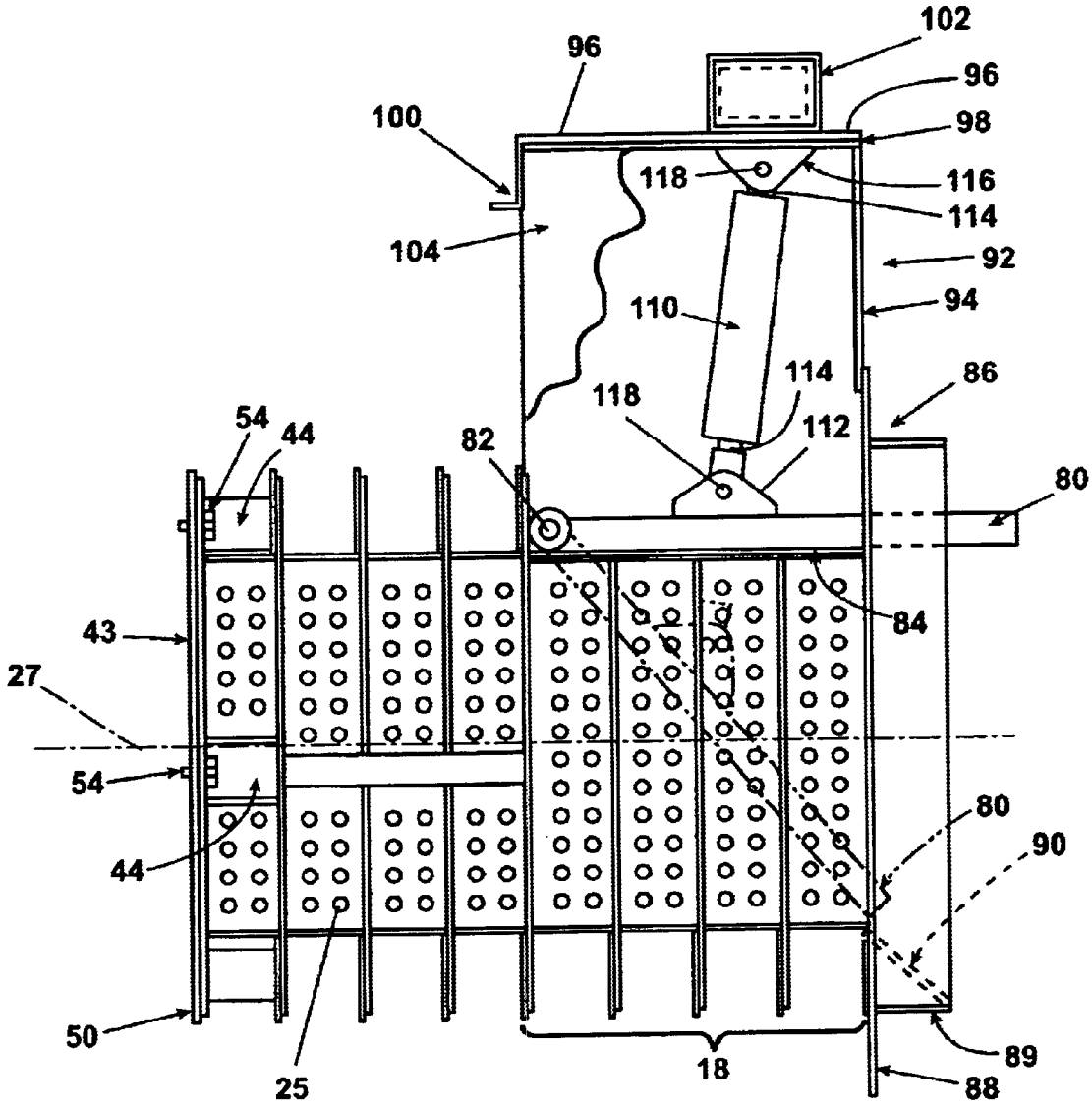
FIG. 3 is a partial side elevation of the dewatering device of FIG. 1 showing the plenum section.

U.S. Pat. No. 5,215,007 to Sebright, et al., entitled Apparatus for Extracting Liquid from a Composite Mass (the Sebright '007 patent) is incorporated herein by reference, and discloses an apparatus that in all respects is equivalent to the invention claimed herein except for the extruder section and snout section. Reference should be made to the Sebright '007 patent for details of the general structure and operation of the invention, except as otherwise set forth herein.

Referring now to the drawings, and to the Sebright '007 patent, it can be seen that an apparatus for extracting liquid from a composite mass as claimed herein comprises generally a hopper 16 mounted atop a horizontal compactor ram assembly 10, having a snout section 12, an extruder section 14, and an extruder plenum assembly 18 mounted in an axial direction to the compactor ram assembly 10.

In accordance with the invention, the snout section 12 is a generally rectangular shaped horizontal duct comprised of two parallel rectangular snout side plates 20, a rectangular snout bottom plate 22, normal to the face of the snout side plates 20, and a parallel rectangular snout top plate 24, which define a longitudinal axis of symmetry 27. The snout side plates 20, the snout bottom plate 22, and the snout top plate 24 are penetrated by a matrix of small drainage holes 25 which permit the liquid to escape during the dewatering process. The extruder section 14 is similarly constructed, having extruder side plates 26, an extruder bottom plate 28 and an extruder top plate 30 all of which are also penetrated by drainage holes 25, and which also define the longitudinal axis 27. The longitudinal axis 27 is also collinear with the cavity axis extending through the cavity within the housing 11 in the Sebright '007 patent.

The preferred embodiment of the invention employs an extruder section 14 which is coaxial with the snout section 12 about the longitudinal axis 27. The extruder section 14 and the snout section 12 together define a channel extending from the cavity to the exit opening. The extruder top plate 30 and the extruder bottom plate 28 are oriented horizontally, with the edges of the top and bottom plates connecting to the extruder plenum 18 at the same elevations as the correlating edges of the snout section 12, so that the extruder top plate 30 is coplanar with the snout top plate 24, and the extruder bottom plate 28 is coplanar with the snout bottom plate 22. The extruder side plates 26 are oriented parallel to each other, with each extruder side plate 26 coplanar with the corresponding snout side plate 20 to which it is connected. Alternatively, the extruder top plate 30 and snout top plate 24 may be replaced by a single top plate of the same width and equal to the combined length of the top plates 30, 24, and the bottom and side plates similarly replaced, to provide an undivided channel section rather than separate extruder and snout sections.

Figure 4:
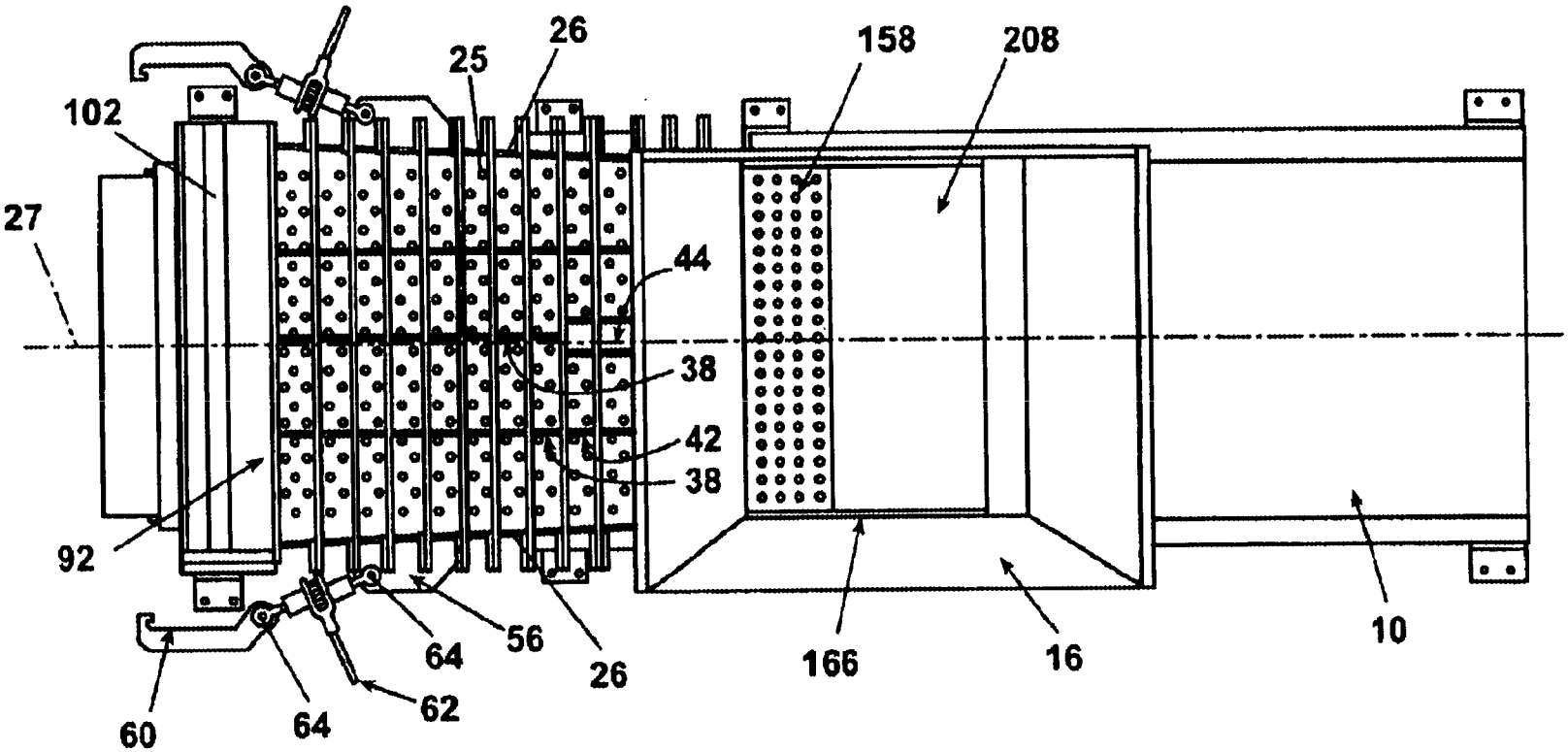
FIG. 4 is a plan view of an alternate embodiment of the dewatering device of FIG. 1.

In an alternative embodiment as shown, for example, in FIG. 4, the invention may employ a diverging extruder section in which one or more of the extruder plates diverge from the longitudinal axis 27 in the direction of the discharge end.

While particular embodiments of the invention have been shown, it will be understood, of course, that the invention is not limited thereto since modifications may be made by those skilled in the art, particular in light of the foregoing teachings. Reasonable variation and modification are possible within the foregoing disclosure of the invention without departing from the scope of the invention.

What is claimed is:

1. An apparatus for extracting liquid from a composite mass of liquids and solids comprising a housing having a cavity for receiving a composite mass of solids and liquid, said cavity having a longitudinal axis extending through an open end of the housing;

a powered first platen is mounted to the assembly relative to the housing for movement from a retracted position away from the open end, along the longitudinal axis through the cavity, to an extended position near the open end;

an extruder section connected to the housing at the open end and having opposed top and bottom walls and opposed side walls, the top, bottom, and side walls defining a channel centered on the longitudinal axis, the extruder extending to an exit opening, each of the walls having a matrix of apertures therethrough, and wherein none of the top, bottom, and side walls converge toward the longitudinal axis, but at least one of walls diverges away from the longitudinal axis in the direction from the open end toward the exit opening; and a second platen is mounted to one of the extruder walls near the exit opening for pivotable movement to restrict the cross-sectional area of the channel wherein the second platen is biased toward a position restricting the cross-sectional area of the channel.

2. An apparatus according to claim 1 wherein the bottom wall is parallel to the longitudinal axis.

3. An apparatus according to claim 2 wherein the side walls diverge from the longitudinal axis in the direction from the open end toward the exit opening.

4. An apparatus according to claim 1 wherein three of the walls diverge from the longitudinal axis in the direction from the open end toward the exit opening.

5. An apparatus according to claim 1 wherein all of the walls diverge from the longitudinal axis in the direction from the open end toward the exit opening.

* * * * *